US009918517B2

(12) United States Patent
Hansen

(10) Patent No.: US 9,918,517 B2
(45) Date of Patent: Mar. 20, 2018

(54) FOOTWEAR ARTICLES WITH EXTENSION APPARATUSES AND METHODS OF USING THE SAME

(71) Applicant: Randy L. Hansen, Bonduel, WI (US)

(72) Inventor: Randy L. Hansen, Bonduel, WI (US)

( * ) Notice: Subject to any disclaimer, the term of this patent is extended or adjusted under 35 U.S.C. 154(b) by 0 days.

(21) Appl. No.: 14/596,897

(22) Filed: Jan. 14, 2015

(65) Prior Publication Data

US 2015/0196094 A1 Jul. 16, 2015

Related U.S. Application Data

(60) Provisional application No. 61/927,555, filed on Jan. 15, 2014.

(51) Int. Cl.

| | |
|---|---|
| ***A43B 23/00*** | (2006.01) |
| ***A43C 13/14*** | (2006.01) |
| ***A43B 3/00*** | (2006.01) |
| ***A43B 3/16*** | (2006.01) |
| ***A43B 23/08*** | (2006.01) |
| ***A43C 19/00*** | (2006.01) |
| *A43B 23/20* | (2006.01) |

(52) U.S. Cl.

CPC ..... *A43C 13/14* (2013.01); *A43B 3/00* (2013.01); *A43B 3/16* (2013.01); *A43B 23/082* (2013.01); *A43C 19/00* (2013.01); *A43B 23/20* (2013.01)

(58) Field of Classification Search

CPC ..... A43B 23/00; A43B 23/081; A43B 23/082; A43B 23/24; A43B 2019/005; A43B 5/025; A43C 13/00; A43C 13/14; A43C 11/08

USPC ..... 36/113, 132, 136; 24/712.5, 713.9, 24/714.3, 714.4

See application file for complete search history.

(56) References Cited

U.S. PATENT DOCUMENTS

| | | | | | |
|---|---|---|---|---|---|
| 756,198 | A | * | 4/1904 | Adams | A43B 7/32 36/136 |
| 757,983 | A | * | 4/1904 | Vaile | A43B 19/005 36/114 |
| 1,726,198 | A | * | 8/1929 | Stahl | A43B 5/02 36/128 |
| 1,744,513 | A | * | 1/1930 | Smith | A43B 5/12 36/113 |
| 2,091,223 | A | * | 8/1937 | Binder | A43C 13/14 36/72 R |
| 2,601,162 | A | * | 6/1952 | McLaughlin | A43B 7/32 36/77 R |
| 2,625,753 | A | * | 1/1953 | Null | A43C 13/14 36/72 R |
| 2,851,798 | A | * | 9/1958 | Phillips | A43C 13/14 36/72 R |
| 2,927,384 | A | * | 3/1960 | Duffy | A43C 13/14 36/72 R |
| 2,995,322 | A | * | 8/1961 | Pragnell | B64D 17/56 244/141 |

(Continued)

*Primary Examiner* — Katharine Gracz

(74) *Attorney, Agent, or Firm* — Scherrer Patent & Trademark, P.C.; Stephen T. Scherrer; Monique A. Morneault

(57) ABSTRACT

The present invention relates to a footwear article, such as a boot, having a knob, hook, platform or other extension protruding on an upper portion thereof. The knob, hook, platform or other extension may be utilized for engaging with a cart, dolly or other movable object for moving the same by moving the wearer's foot. Methods of using the same are further provided.

6 Claims, 6 Drawing Sheets

(56) References Cited

U.S. PATENT DOCUMENTS 3,037,304 A * 6/1962 Duffy ..... A43B 23/082 36/72 R
3,045,367 A * 7/1962 McKeon ..... A43C 13/14 36/72 R
3,126,651 A * 3/1964 Bown ..... A43C 13/14 36/72 R
3,241,153 A * 3/1966 Brewer ..... A43C 13/14 2/22
3,334,427 A * 8/1967 Edwards ..... A43C 13/14 36/72 R
3,407,518 A * 10/1968 MacQuaid ..... A43C 13/14 36/72 R
3,421,234 A * 1/1969 Sargent ..... A43B 23/082 36/72 R
3,698,736 A * 10/1972 Shape ..... B62B 1/12 254/8 R
3,783,534 A * 1/1974 Phillips ..... A43B 23/26 36/131
3,841,004 A * 10/1974 Gray ..... A43C 13/10 36/72 R
3,851,410 A * 12/1974 Frazier ..... A43B 5/02 36/133
3,995,382 A * 12/1976 Smith ..... A43B 23/082 36/72 R
4,051,612 A * 10/1977 Damron ..... A43C 13/14 36/72 R
4,231,170 A * 11/1980 Griswold ..... A43B 3/16 36/72 R
4,422,249 A * 12/1983 Hannah ..... A43B 5/025 36/133
4,455,764 A * 6/1984 Rock ..... A43B 7/02 36/136
4,617,746 A * 10/1986 Hannah ..... A43B 5/025 36/128
4,780,970 A * 11/1988 McArthur, Sr. ..... A43B 3/20 36/72 R
4,780,971 A * 11/1988 Verdi ..... A43B 5/0419 36/117.4
4,811,501 A * 3/1989 Okayasu ..... A43C 13/14 36/77 R
4,967,493 A * 11/1990 Mues ..... A43C 13/14 36/126
4,991,318 A * 2/1991 Cornell ..... A43B 3/20 36/72 R
5,269,081 A * 12/1993 Gray ..... A43B 7/00 36/136
5,621,986 A * 4/1997 Medina ..... A43B 3/102 36/11.5
5,711,092 A * 1/1998 Despres ..... A43C 13/14 36/133
6,122,340 A * 9/2000 Darley ..... G01P 15/08 377/23
6,131,312 A * 10/2000 Hung ..... A43B 7/32 36/11.5
6,223,457 B1 * 5/2001 Graf ..... A43B 5/1683 280/11.12
6,286,234 B1 * 9/2001 Smith, Jr. ..... A43B 5/145 36/131
6,817,498 B1 * 11/2004 Spratt ..... A43B 3/0031 224/191
7,152,286 B2 * 12/2006 Rooney ..... A43B 1/0054 24/712.6
7,313,842 B1 * 1/2008 Preciado ..... A43B 3/00 15/105
7,833,137 B2 * 11/2010 Garnuette ..... A63B 21/06 36/132
D682,373 S * 5/2013 Garnuette ..... D21/683
2001/0001168 A1 * 5/2001 Zazzi ..... A43B 5/0401 36/132
2002/0166264 A1 * 11/2002 Shepherd ..... A43B 3/00 36/132
2008/0163519 A1 * 7/2008 Sartor ..... A43B 23/086 36/77 M
2012/0180182 A1 * 7/2012 Wade ..... A43B 5/025 2/22
2013/0031802 A1 * 2/2013 Park ..... A43B 3/0036 36/84
2014/0259797 A1 * 9/2014 Atkins ..... A43B 7/32 36/136

* cited by examiner

FOOTWEAR ARTICLES WITH EXTENSION APPARATUSES AND METHODS OF USING THE SAME

The present invention claims priority as a non-provisional application under 35 U.S.C. 119 to U.S. Provisional Patent Application No. 61/927,555 entitled "Boot with Knob, Hook or Platform Apparatuses and Methods of Using the Same," filed Jan. 15, 2014, which is incorporated herein by reference in its entirety.

TECHNICAL FIELD

The present invention relates to a footwear article having an extension, such as a knob, hook or platform on an upper portion thereof. The extension may be utilized for engaging with a cart, dolly or other movable object for moving the same by moving the wearer's foot and leg. Methods of using the same are further provided.

BACKGROUND

It is, of course, generally known to utilize carts, dollies and other apparatuses for moving, transporting, and/or storing objects thereon. For example, there are many types of dollies that may be used to move objects, such as furniture dollies and appliance dollies. A furniture dolly comprises a square or rectangular, horizontal frame, short, broad platform on wheels or casters, typically made of wood, but the dolly may be made of any material, such as metal. An appliance dolly typically consists of a relatively short platform shaped like a thin plate, and a long, slender metallic frame that is disposed ninety degrees to the short platform, with a plurality of wheels disposed at the ninety degree junction, having one or more handles on a top end of the frame for tilting the dolly. The appliance dolly can support items on the platform and the frame, and can be moved by the wheels when the appliance dolly is tilted.

FIGS. 1 and 2 illustrate these prior art types of dollies. It should be noted, however, that the present invention relates to any movable cart or platform that a person may utilize to move objects consisting of a platform and wheels or other floor contacting elements. For example, movement of a sled on rails is contemplated by the present invention. For purposes of the present invention, the above-identified dollies will be discussed, but the invention should not be limited as described herein.

Oftentimes, a user of a dolly will place one or more items on the dolly for moving the same using the wheels or other floor contacting elements thereunder. As noted above, for example, a user may place one or more items on the short platform of an appliance dolly, grasp the handle on the top end of the metal frame, and tilt the dolly back to be rollable on the wheels. The one or more items thereon will be held on the platform by gravity, forcing the one or more items onto the surface of the platform and also against the metallic frame. In many cases, straps may be secured around the one or more items to provide additional security so that the one or more items do not fall off the platform and metallic frame when moved.

When a user wishes to remove the appliance dolly from beneath the one or more items, the typical method of doing so involves the user tilting the appliance dolly up so that the platform rests on the floor or ground, with the objects atop the platform surface. Next, the user bends over and grasps the metallic frame and attempts to move the platform rearwardly from beneath the one or more items. Typically, this requires the user to bend over and grasp a handle, bar, wheel axle or other like element toward the bottom of the dolly and pull with force rearwardly so that the platform, typically a thin sheet of metal, slides from beneath the one or more items.

This method, requiring the user to bend over and grasp and pull the dolly, places the user in an unnatural position, and potentially causes stress to the user's back muscles and supporting structure. Bending and pulling may be detrimental to a user, especially a user who already suffers from back problems. And if a user repeatedly carries out this motion, he or she may develop serious back issues over time. For example, a mover may move many objects via a dolly, such as an appliance dolly, and each time he or she must remove the dolly from beneath the one or more objects, he or she may be required to bend over and pull. This motion may be required multiple times per day.

Moreover, in many cases, the dolly itself may be quite heavy, and the amount of force required to move the dolly from beneath one or more items may be substantial, contributing to damaging the user's back or other bodily structure. A need exists, therefore, for apparatuses and methods of using the same that allows a user to move a dolly without undue strain on the user's back. More specifically, a need exists for footwear article extension apparatuses and methods of using the same that may be utilized by a wearer to easily and efficiently move a dolly using the wearer's leg power instead of the wearer's back and arms.

In addition, a need exists for apparatuses and methods of using the same that provides an easy and convenient means for a user to move a dolly. Further, a need exists for apparatuses and methods of using the same that is easy for a user to wear and use.

Moreover, a need exists for apparatuses and methods of using the same that may be integrally connected or molded to a footwear article and worn by a user. Alternatively, a need exists for apparatuses and methods of using the same that may be strapped onto a footwear article or slipped onto a footwear article for use of the same.

SUMMARY OF THE INVENTION

The present invention relates to a footwear article having an extension, such as a knob, hook or platform on an upper portion thereof. The extension may be utilized for engaging with a cart, dolly or other movable object for moving the same by moving the wearer's foot and leg. Methods of using the same are further provided.

To this end, in an embodiment of the present invention, an integrally connected extension is provided on an upper portion of a footwear article. The extension is connected to the upper portion of the footwear article, and allows a user to hook the extension with an engaging surface on a dolly or other movable object to move the same using the user's foot and leg.

It is, therefore, an advantage and objective of the present invention to provide apparatuses and methods of using the same that allows a user to move a dolly or other movable object without undue strain on the user's back.

More specifically, it is an advantage and objective of the present invention to provide footwear article extension apparatuses and methods of using the same that may be utilized by a user to easily and efficiently move a dolly or other movable object using the user's leg power instead of the user's back and arms.

In addition, it is an advantage and objective of the present invention to provide apparatuses and methods of using the same that allows an easy and convenient means for a user to move a dolly or other movable object.

Further, it is an advantage and objective of the present invention to provide apparatuses and methods of using the same that is easy for a user to wear and use.

Moreover, it is an advantage and objective of the present invention to provide apparatuses and methods of using the same that may be integrally connected or molded to a footwear article and worn by a user.

Alternatively, it is an advantage and objective of the present invention to provide apparatuses and methods of using the same that may be strapped onto a footwear article or slipped onto a footwear article for use of the same.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to a footwear article having an extension, such as a knob, hook or platform on an upper portion thereof. The extension may be utilized for engaging with a cart, dolly or other movable object for moving the same by moving the wearer's foot and leg. Methods of using the same are further provided.

The term "boot" is used herein to refer to a specific type of footwear article that relates to a preferred embodiment of the present invention. The term is intended for exemplary purposes only and the present invention may be utilized on other footwear including, without limitation, shoes, socks, and/or foot accessories.

The terms "steel toe" or "steel plate" are used herein to refer to the protection of toes within footwear articles, namely boots. The terms are intended to include all methods known to one skilled in the art to protect toes within boots, such as with plastic plates, composite plates, or the like, and not only to refer to boots that have a "steel" toe or a "steel" plate.

Figure 1:
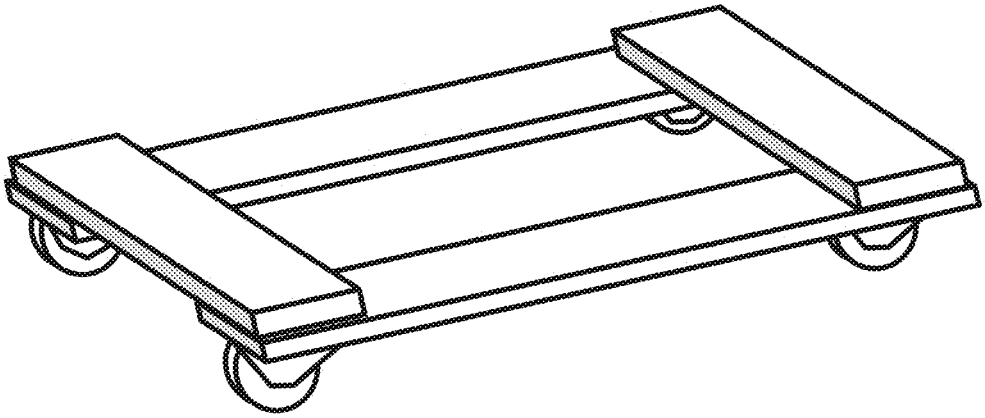
FIG. 1 PRIOR ART
FIG. 1 illustrates a prior art furniture dolly.
Figure 2:
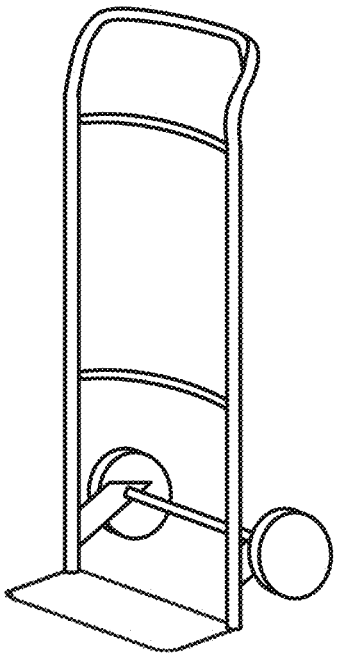
FIG. 2 PRIOR ART
FIG. 2 illustrates a prior art appliance dolly.
Figure 3:
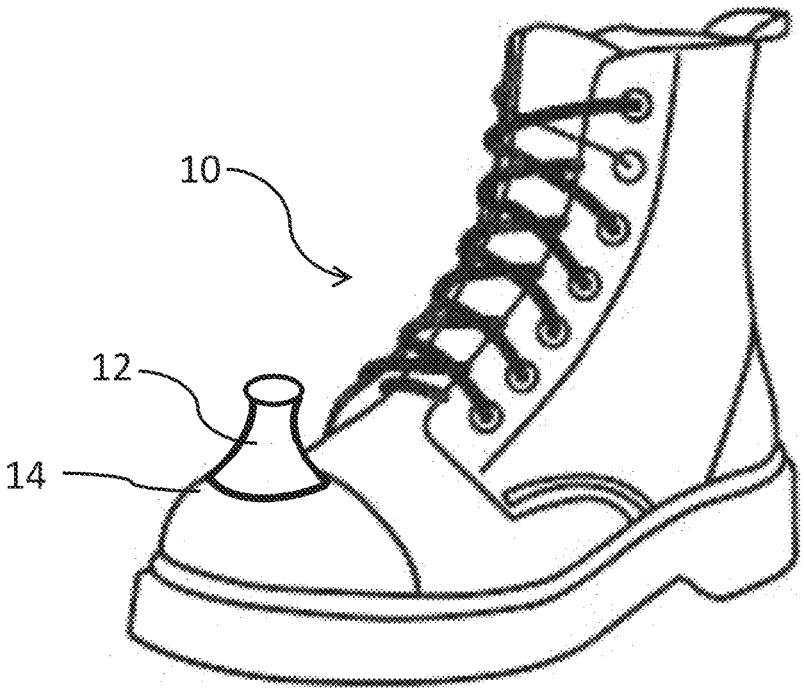
FIG. 3 illustrates a perspective view of a footwear article having a knob extension on an upper portion thereof in an embodiment of the present invention.
Figure 5:
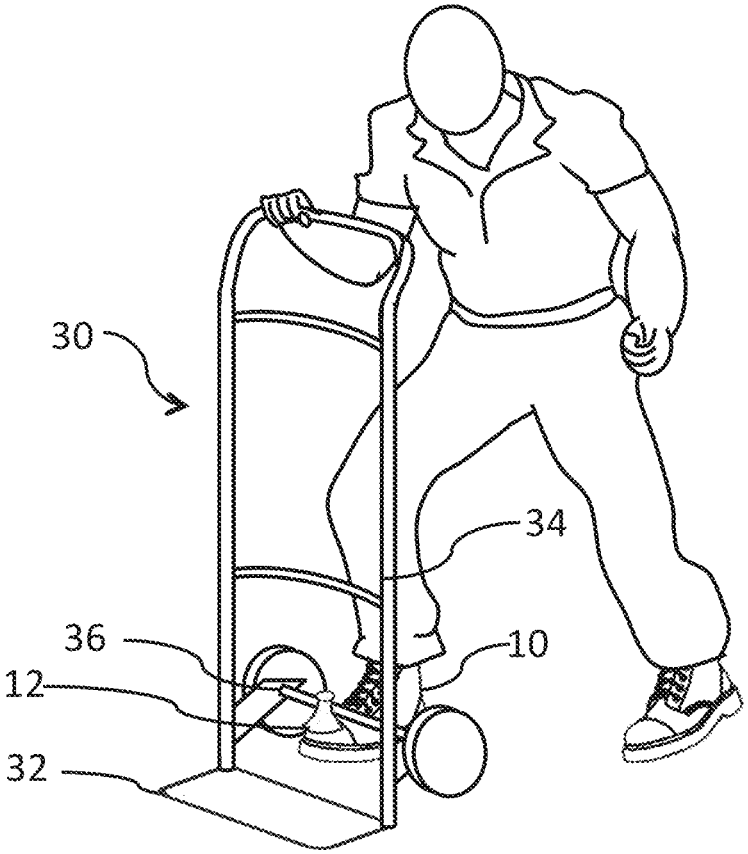
FIG. 5 illustrates a footwear article being utilized to move an appliance dolly in an embodiment of the present invention.

Now referring to the figures, wherein like numerals refer to like parts, FIG. 3 illustrates a perspective view of a footwear article 10 in an embodiment of the present invention. In a preferred embodiment, as shown by the figures, the footwear article may be a boot. The footwear article 10 may be any footwear that may be worn by an individual, such as a construction boot, a steel toe boot, a shoe, a sock or any other footwear article apparent to one of ordinary skill in the art. The footwear article may have an extension, such as a knob 12, thereon, disposed on an upper portion 14 of the footwear article 10. The knob 12 may preferably be integrally attached or connected to the footwear article 10 via molding or otherwise formed with the footwear article 10. Specifically, the footwear article and the extension may be a unitary molded or manufactured piece. Alternatively, the extension may be removably attached thereto, such as via screws, nails, pins, adhesives, straps, glue, buttons, tape, or the like. The knob 12 may be utilized to engage with a bar on a dolly or other like device for moving the same using the knob 12 and the user's foot and leg, as illustrated in FIG. 5 and described below in more detail.

Preferably, the knob 12 may be integrally connected to a steel plate portion (not shown) that may be disposed within the footwear article 10, forming what is commonly termed a "steel toe." The knob may extend from the steel plate portion, thereby providing strength and rigidity to the knob 12 for use thereof in moving dollies, as described below The knob 12 may be made from any material apparent to one of ordinary skill in the art, such as metal, plastic, composite, or any combination thereof, so long as the knob 12 has sufficient strength and rigidity to be useful as described herein.

The knob 12 or any other extension may be any size and/or shape apparent to one skilled in the art such that the extension may engage a bar or other like element on a dolly or other movable object for moving the same. As illustrated in FIG. 3, the knob 12 may be roughly "volcano" shaped, having sloping sides and a flat top. It should be noted, however, that the knob 12 may be any shape and/or size useful for engaging a bar on a dolly for moving the same.

Figure 4:
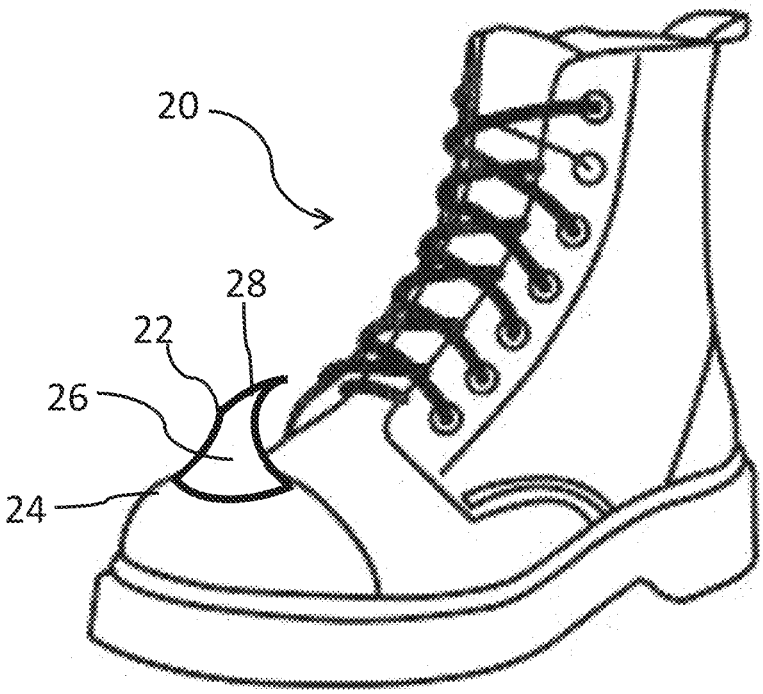
FIG. 4 illustrates a perspective view of a footwear article having a hook extension on an upper portion thereof in an embodiment of the present invention.

For example, FIG. 4 illustrates an alternate embodiment of the present invention of an extension, such as a hook 22, that may be disposed on an upper portion 24 of a footwear article 20. The hook 22 may have a main body portion 26 and a hook portion 28 extending rearwardly therefrom. Thus, the hook 22 may be useful to engage a bar on a dolly or other movable object for moving the same, by hooking the bar and moving the bar and dolly rearwardly using the user's foot and leg, as described below.

FIG. 5 illustrates footwear article 10 being used to move a dolly 30 or other movable object. The dolly 30 may be used to move objects thereon by placing the objects to be moved (not shown) on a platform 32 and using a metal frame 34 connected thereto to move the objects thereon, as is apparent to one of ordinary skill in the art. When removal of the dolly from the items is desired, the user may move his or her foot with footwear article 10 thereon under bar 36, as illustrated in FIG. 5, and engage bar 36 with knob 12. With a pulling motion rearwardly, the user may move the dolly 30 from under the objects, thereby moving the platform 32 from beneath the objects.

It should be noted that although the present invention describes the footwear article 10 being used to move an appliance dolly, the footwear article of the present invention may be utilized to move any item useful by engaging the knob 12, 52, 72, hook 22, platform 92, or other like extension thereon and moving the same using the user's foot and leg, rather than having the user bend over and risk damaging the user's back or other body part.

Figure 10:
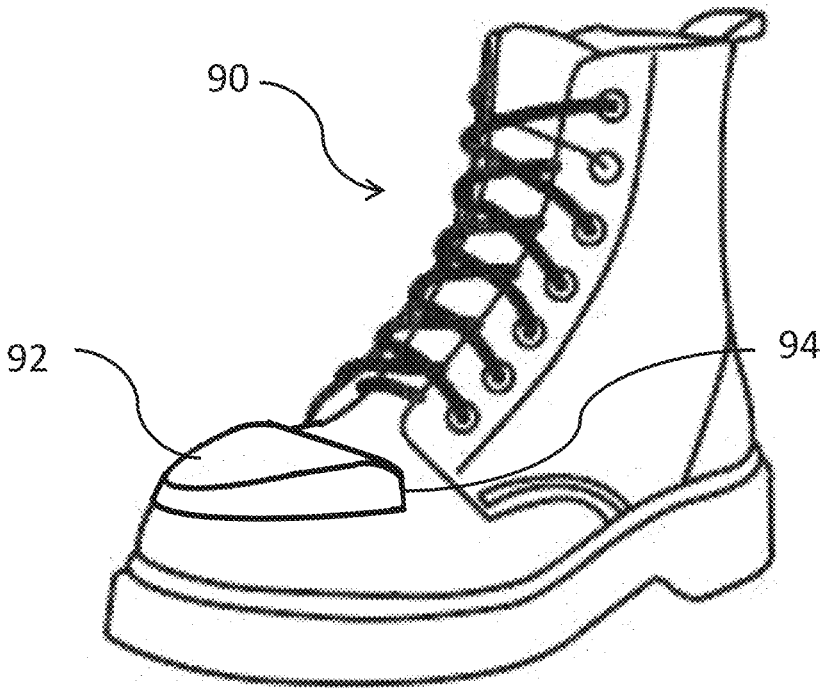
FIG. 10 illustrates a footwear article having a platform portion extension disposed thereon in an embodiment of the present invention.

It should be noted that the knob 12, hook 22, or any other like extension may be utilized to perform the functions as specified herein for engaging with and moving a movable object. For example, a platform 92, as illustrated in FIG. 10 and described below, may be utilized in place of the knob 12 or hook 22. These extensions may be placed in any location on a footwear article to use the same to move objects, such as dollies, for example, as described herein. For example, the knob 12, 52, 72, hook 22, platform 92, or other like extension may protrude from the vamp of the footwear article, the tongue of the footwear article, the front toe portion of the footwear article, the toe cover, or from any other location, so long as the footwear article may be used to engage a dolly and move the same.

Figure 6:
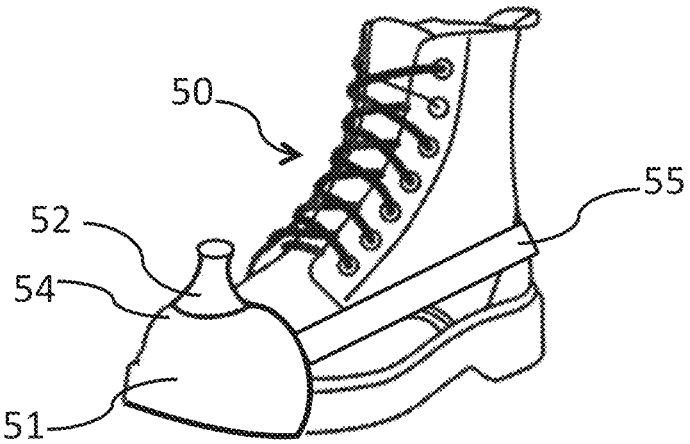
FIG. 6 illustrates a footwear article having a detachable front portion having a knob extension thereon in an embodiment of the present invention.

Now referring to FIG. 6, an alternate embodiment of a footwear article 50 is illustrated. The footwear article 50 may be any footwear article apparent to one of ordinary skill in the art. The footwear article 50 may comprise a cap 51 having a knob 52 thereon extending from an upper portion 54 of the cap 51. The cap 51 may be placed over the toe of the footwear article 50, and held in place by one or more straps 55. For example, the one or more straps 55 may extend around the back of the footwear article 50, such as, for example, around the heel portion or above the heel portion of the footwear article 50 and engage the cap 51 on the other side (not shown) to hold the cap 51 in place. Buckles or other adjustment means (not shown) may be present on the one or more straps 55 to adjust the same and ensure a snug fit of the cap 51 on the footwear article 50.

The cap 51 may be made from any material useful to have strength and resiliency when in use. For example, the cap 51 may be made from steel, and use of the cap 51 on the footwear article 50 may serve the dual purpose of attaching the knob 52 to the footwear article 50 for use in moving dollies, as described above, and also to provide a steel plate to protect the wearer's toes. Thus, the cap 51 may add a "steel toe" portion to the footwear article 50 providing additional protection for the wearer thereof, especially if the wearer's footwear article does not originally include a steel toe portion.

Figure 7:
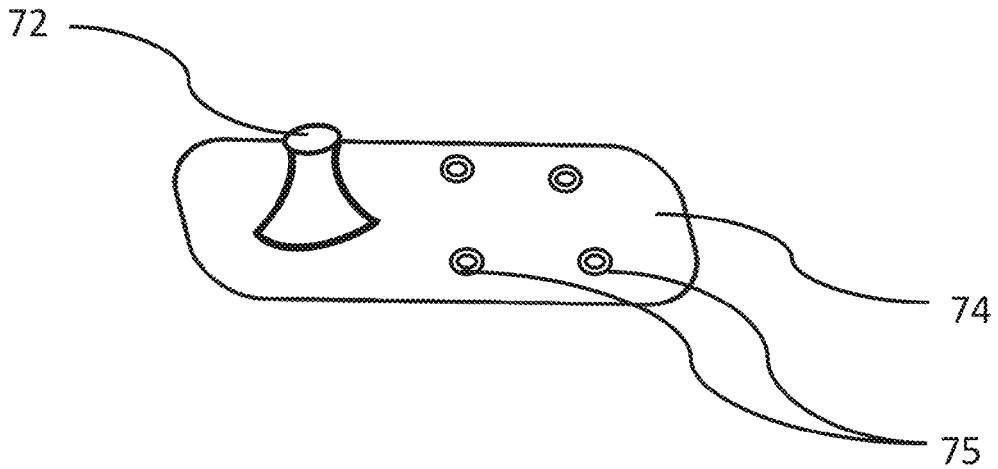
FIG. 7 illustrates a detachable portion having a knob extension thereon in an embodiment of the present invention.

Now referring to FIG. 7 illustrates a knob 72 disposed on a bridge 74. Specifically, the bridge 74 may have a plurality of holes 75 that may be capable of accepting laces 76 from a footwear article 70, shown in FIG. 8. The bridge 74 may be laced at any point on a user's footwear article. The bridge 74 may be rigidly formed to the footwear article or may be non-rigid as shown in FIG. 7. The knob 72, however, may preferably be rigid. When the bridge 74 is disposed on the footwear article 70, such as in FIG. 8, the knob 72 should be able to hook to an appliance dolly. A user may be able to pull the footwear article and the appliance dolly, which may pull on the laces 76 disposed with the plurality of holes 75 and pull against the user's foot. The bridge 74 need not be rigid, however should have sufficient strength to withstand the forces from pulling an appliance dolly and anything thereon. Of course, the bridge 74 may attach in any number of ways including hooks, loops, buttons, clasps, or other attachment known to one skilled in the art. The bridge 74 may allow the knob 72 to be placed on and removed from any footwear article.

Figure 8:
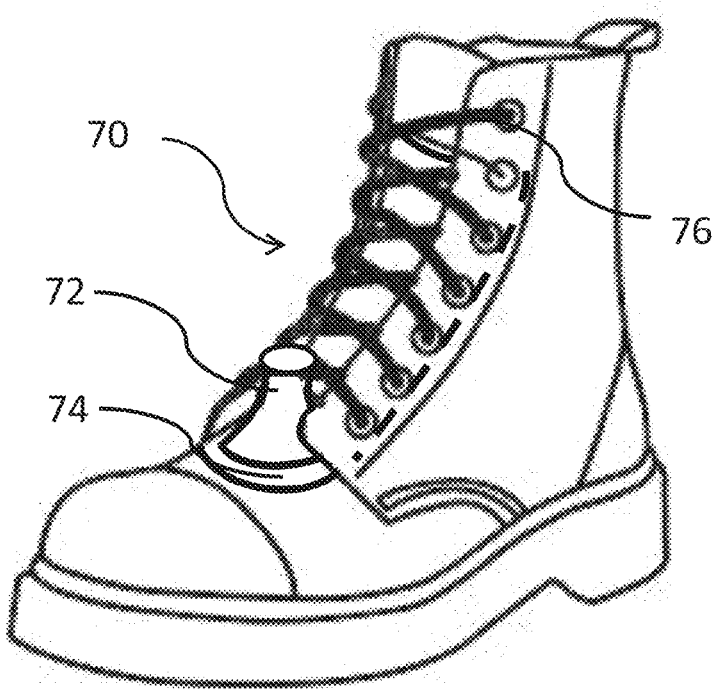
FIG. 8 illustrates a footwear article having a detachable portion having a knob extension thereon disposed beneath laces of the footwear article in an embodiment of the present invention.
Figure 9:
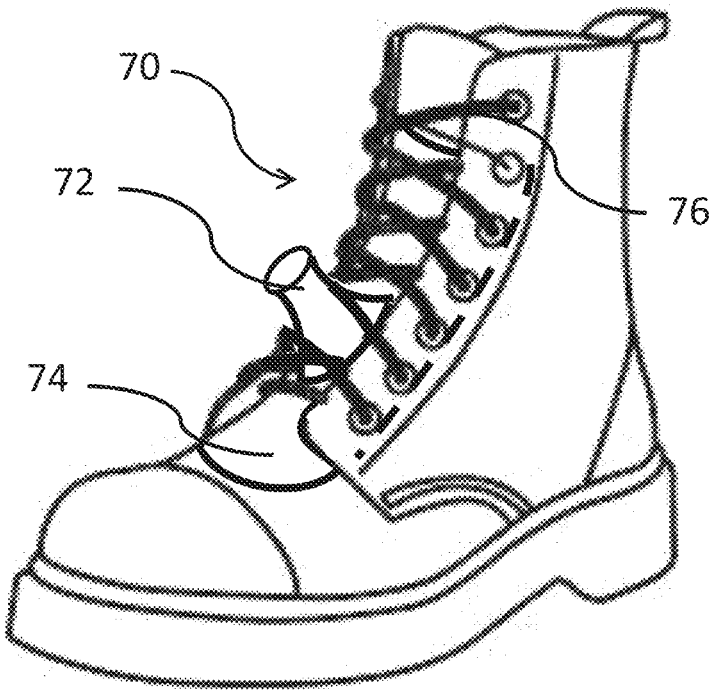
FIG. 9 illustrates a footwear article having a detachable portion having a knob extension thereon disposed through laces of the boot in an embodiment of the present invention.

FIG. 8 shows an embodiment of the bridge 74 disposed on the footwear article 70. The footwear article 70 may be any boot, shoe or other footwear article having laces or other means for binding the upper portion thereof together, as is apparent to one of ordinary skill in the art. The bridge 74 may be disposed beneath the laces 76, above the laces 76, through the laces 76, or another lacing method known to those skilled in the art. For example, the bridge 74 may be disposed beneath the laces 76 as shown in FIGS. 8-9. As shown in FIG. 9, the knob 72 may be disposed on a midpoint of the bridge 74, and may be further intertwined between the laces 76. Alternatively, the bridge 74 may be laced at a higher point of the footwear article 70 without changing the location of the knob 72. Of course, the knob 72 may be disposed on any location of a footwear article known to one skilled in the art, such that the knob 72 allows a user to engage a dolly and move the same. Specifically, in one embodiment, the knob 72 may be located at the tip of the footwear article, such as over the toes of a user, and the bridge 74 may be laced at a lower point of the footwear article 70. Further, the knob 72 may be replaced with a hook or any like element.

FIG. 10 illustrates an alternate embodiment of the present invention. A footwear article 90 may have an extension, such as a platform 92, instead of a hook or knob, as described above. The platform 92 may be capable of being placed beneath a pallet, appliance dolly, or the like in order to pull, maneuver, and/or direct the pallet, appliance dolly, or the like as described above. The platform 92 may be disposed on the toe of the footwear article 90 as shown in FIG. 10, but may be placed anywhere on the footwear article. The platform 92 may provide a larger surface for supporting and connecting to a pallet, dolly, or the like. The platform 92 may further spread the tension to a larger area of the footwear article, which may cause less strain and provide a longer lifetime of use.

The platform 92 may be angled upwardly toward the laces of the footwear article 90 such that a pallet, dolly, or the like may slide more easily up and over the platform 92. Of course, the platform 92 may be flat or may be angled downwardly toward the laces of the footwear article 90. The platform 92 may be made of a solid material, or alternatively may be made of a soft material such as putty, foam, gel, or alternate material known to one skilled in the art that may protect a user's foot and/or deform to hold and/or grasp a movable object, such as a dolly, for example, when placed in contact therewith. The platform 92 may have curved edges, as shown in FIG. 10, however may have a flat edge 94 that may brace a pallet, dolly, or the like against the flat edge 94 when in use. The platform 92 may be permanently attached to the footwear article 90 or may be detachable using straps, glue, buttons, tape, screws, nails, pins, adhesives, or other securing means known to one skilled in the art. Of course, the platform 92, or other extension may be unitary with the footwear article 90 as a single molded piece, thereby eliminating the need for securing means. Preferably, the platform 92 may be about ¾ of an inch above the toe of the footwear article 90, but may be of any size or shape so long as the footwear article 90 functions as described herein.

Figure 11:
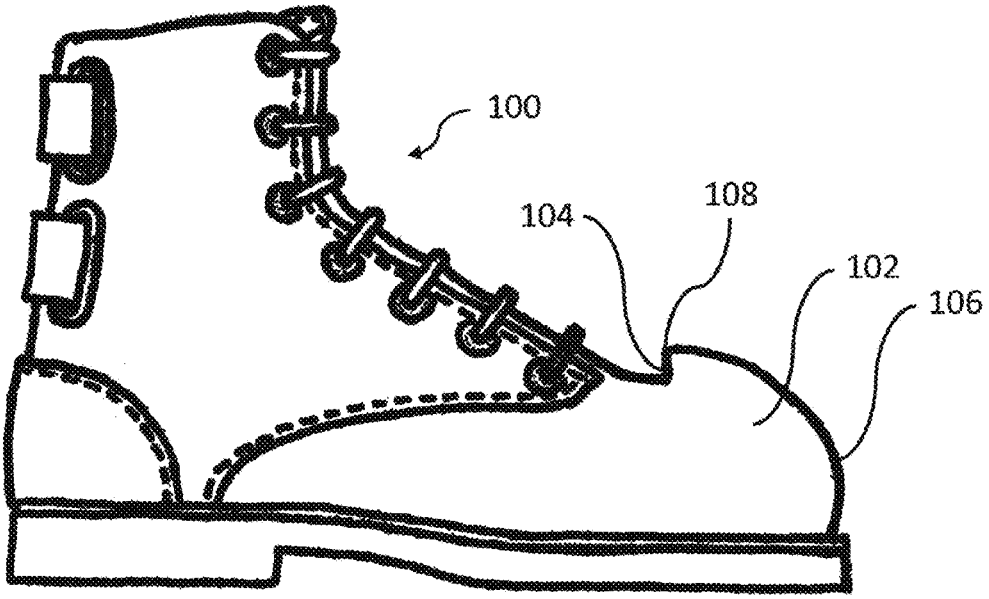
FIG. 11 illustrates a footwear article having a raised extension protruding from an upper front portion of the footwear article in a preferred embodiment of the present invention.
Figure 12:
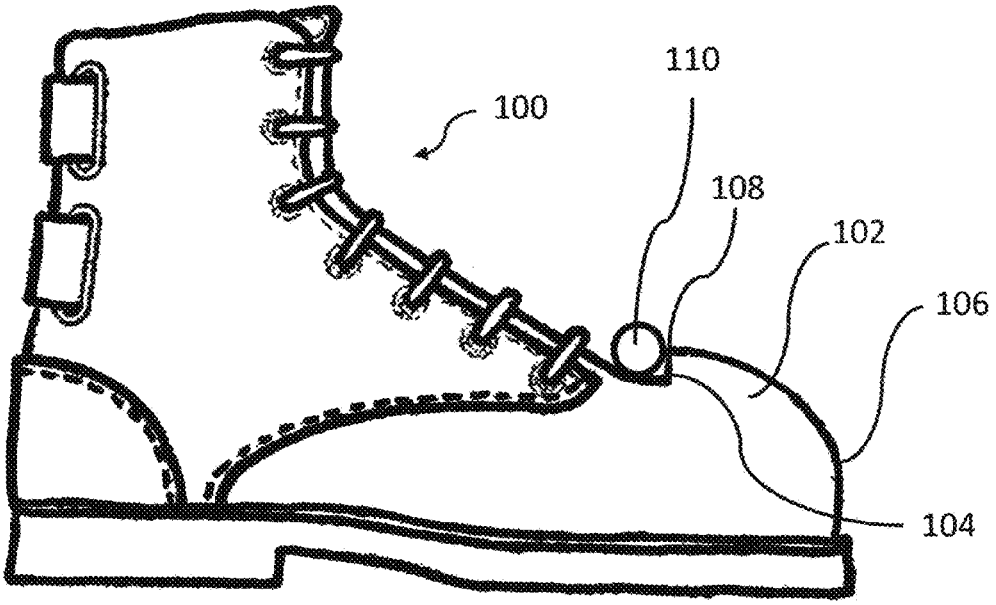
FIG. 12 illustrates the footwear article from FIG. 11 hooking onto a movable object in a preferred embodiment of the present invention.

As further shown in FIGS. 11-12, an extension, such as a raised front portion 102, may be disposed on a front of footwear article 100. In a preferred embodiment, the footwear article 100 may be a boot with a steel toe. However, the footwear article 100 may be another protective device such as a shoe, a glove, a sock, or other known protective device known to one skilled in the art.

The raised front portion 102 may be similar to the previously discussed platform 92, but may be a part of the footwear article 100 wherein the raised front portion 102 and the footwear article 100 are a unitary molded or manufactured piece. Alternatively, the raised front portion 102 may be disposed on the footwear article 100 with adhesive, nails, straps, screws, pins, adhesives, glue, buttons, tape, or other like securing means. The raised front portion 102 may have a curved edge 106 for facilitating movement of objects thereover and a flat edge forming a vertical surface 104 disposed perpendicularly from the top of the platform to the vamp of the footwear article that may brace a pallet, dolly, or other like movable object 110, as shown in FIG. 12, against the flat edge 104 when in use. Specifically, a movable object, a portion of a movable object, or a tool or a portion of a tool for manipulating movable objects 110 may contact the curved edge 106 and progress upward over the curved edge 106, which may provide a continuous smooth surface from the outsole adjacent a toe portion of the footwear article to the vertical surface 104, as illustrated in FIG. 11. Said object, tool, or portion thereof 110 may subsequently progress over a lip 108 and drop below a top surface of the curved edge 106. Thereafter, the object, tool, or portion thereof 110 may be disposed adjacent the vertical surface 104, whereby the object, tool, or portion thereof 110 may be subject to manipulation by the footwear article 100 and any users of the footwear article 100, as shown in FIG. 12.

The particular embodiments shown in the figures and described in the application are non-limiting, exemplary, and the invention covers any means of extending a footwear article, such as a boot, or any means attached to a footwear article that allows the footwear article to engage, maneuver, direct, and pull a pallet, dolly, or the like as describes herein. Of course, as previously stated, the present invention may be attached to an object other than a footwear article without departing from the scope described inherently and expressly herein.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are non-limiting, and it should be noted that claim limitations presented herein are not meant to describe the invention as a whole. Moreover, the invention illustratively disclosed herein suitably may be practiced in the absence of any element which is not specifically disclosed herein.

I claim:

1. A method for moving a dolly comprising the step of:

providing a dolly having wheels, an underside and a bar running laterally across the underside; and providing a boot having a vamp portion, a toe portion and an outsole, and a platform rigidly held to and protruding a distance above the vamp portion of the footwear article, further wherein the platform comprises a top and a vertically-disposed flat edge forming a vertical surface disposed perpendicularly and continuously from the top of the platform to the vamp of the footwear article on a rear side of the platform and further wherein the top runs from the toe portion of the footwear article to the vertically-disposed flat edge providing a continuous smooth surface from the outsole adjacent the toe portion to the vertical surface, and further wherein the vertical surface provides an engaging surface configured to engage the vertical surface to the bar on the dolly, thereby providing maneuverability of the dolly;

wearing the boot and placing the boot behind the dolly;

moving the boot forwardly and placing the boot under the dolly;

engaging the bar on the underside of the dolly by disposing the vertically-disposed flat edge of the platform on the boot against the bar on the underside of the dolly;

moving the boot in a rearward direction to move the dolly rearwardly by pulling on the bar with the vertically-disposed flat edge of the platform on the boot.

2. The method of claim 1 further comprising the steps of:

providing a large object disposed on top of the dolly;

engaging the bar of the dolly with the flat edge of the platform of the boot; and removing the dolly from under the large object by pulling the dolly rearwardly.

3. The method of claim 1 wherein the platform comprises a curved surface running from the vertically-disposed flat edge toward the outsole at a front of the footwear article, the method further comprising the steps of:

moving the boot so that the bar traverses along the curved surface of the platform until the bar rests against the vertically-disposed flat edge of the platform; and pulling the boot rearwardly, wherein the flat edge of the platform pulls the bar of the dolly and thereby pulls the dolly rearwardly.

4. The method of claim 1 wherein the boot has a steel plate portion disposed below the vamp portion where the platform is disposed.

5. The method of claim 1 wherein the platform and the boot are unitarily manufactured.

6. The method of claim 1 wherein the platform is attached to the boot via a securement selected from the group consisting of straps, glue, buttons, tape, screws, nails, pins, adhesives, and any combination thereof.

* * * * *